US010829844B2

(12) United States Patent
Muller et al.

(10) Patent No.: US 10,829,844 B2
(45) Date of Patent: Nov. 10, 2020

(54) METAL SHEET FOR A MOTOR VEHICLE BODY HAVING HIGH MECHANICAL STRENGTH

(71) Applicant: CONSTELLIUM NEUF-BRISACH, Biesheim (FR)

(72) Inventors: Estelle Muller, Grenoble (FR); Mary-Anne Kulas, Colmar (FR); Olivier Rebuffet, Grenoble (FR)

(73) Assignee: CONSTELLIUM NEUF-BRISACH, Biesheim (FR)

( * ) Notice: Subject to any disclaimer, the term of this patent is extended or adjusted under 35 U.S.C. 154(b) by 48 days.

(21) Appl. No.: 15/578,735

(22) PCT Filed: Jun. 3, 2016

(86) PCT No.: PCT/FR2016/051333

§ 371 (c)(1),
(2) Date: Dec. 1, 2017

(87) PCT Pub. No.: WO2016/193640

PCT Pub. Date: Dec. 8, 2016

(65) Prior Publication Data

US 2018/0179621 A1 Jun. 28, 2018

(30) Foreign Application Priority Data

Jun. 5, 2015 (FR) ..... 15 55129

(51) Int. Cl.
*B22D 11/00* (2006.01)
*C22F 1/053* (2006.01)
(Continued)

(52) U.S. Cl.
CPC ..... *C22F 1/053* (2013.01); *B22D 11/003* (2013.01); *B22D 11/041* (2013.01); *C22C 21/02* (2013.01);
(Continued)

(58) Field of Classification Search
None
See application file for complete search history.

(56) References Cited

U.S. PATENT DOCUMENTS 5,888,320 A 3/1999 Dorward
6,231,809 B1 * 5/2001 Matsumoto ..... C22C 21/02 148/438

(Continued)

FOREIGN PATENT DOCUMENTS

JP H05112840 A 5/1993
JP 2003268475 * 9/2003
JP 2007262484 * 10/2007

OTHER PUBLICATIONS

International Search Report of International Patent Application No. PCT/FR/2016/051333 dated Sep. 2, 2016.

*Primary Examiner* — Daniel J. Schleis
(74) *Attorney, Agent, or Firm* — McBee Moore & Vanik IP, LLC

(57) ABSTRACT

The subject matter of the invention is a sheet for stamped lining or structural parts for an auto body stilled referred to as a body-in-white, made of aluminum alloy having the following composition (% by weight): Si: 0.85-1.20, Fe: <0.30, Cu: 0.10-0.30, Mg: 0.70-0.90, Mn: <0.3; Zn: 0.9-1.60, V: 0.02-0.30, Ti: 0.05-0.20, other elements <0.05 each and <0.15 total, balance aluminum, having, after solution heat treatment, quenching, pre-aging or reversion, possible aging at ambient temperature for 72 hours to 6 months, 2% controlled tensile pre-deformation, and paint baking treatment for 20 minutes at 185° C., an elastic limit Rpo.2 of at least 300 MPa. The sheets according to the invention make it possible to reduce the thickness of the parts while still meeting all the other required properties.

19 Claims, 2 Drawing Sheets

(51) Int. Cl.

| | |
|---|---|
| ***C22F 1/05*** | (2006.01) |
| ***C22C 21/02*** | (2006.01) |
| ***C22C 21/08*** | (2006.01) |
| ***C22C 21/10*** | (2006.01) |
| ***B22D 11/041*** | (2006.01) |
| ***C22F 1/00*** | (2006.01) |

(52) U.S. Cl.
CPC ..... *C22C 21/08* (2013.01); *C22C 21/10* (2013.01); *C22F 1/002* (2013.01); *C22F 1/05* (2013.01)

(56) References Cited

U.S. PATENT DOCUMENTS

2003/0087123 A1 5/2003 Benedictus et al.
2010/0247369 A1* 9/2010 Morimoto ..... C22C 21/02
420/535

* cited by examiner

METAL SHEET FOR A MOTOR VEHICLE BODY HAVING HIGH MECHANICAL STRENGTH

CROSS REFERENCE TO RELATED APPLICATIONS

This application is a National Stage entry of International Application No. PCT/FR2016/051333 filed 3 Jun. 2016, which claims priority to French Patent Application No. 15/55129, filed 5 Jun. 2015, which is hereby incorporated by reference in its entirety.

BACKGROUND

Field of the Invention

The invention refers to the field of sheet made of Al—Si—Mg alloy and more specifically type AA6xxx alloy according to the designation of the "Aluminum Association," to which are added hardening elements, intended for the stamping manufacture of lining, structural, or reinforcement parts of the body-in-white of motor vehicles.

Description of Related Art

Preliminarily, unless indicated otherwise, all aluminum alloys considered in the following text are designated according to the designations defined by the "Aluminum Association" in the "Registration Record Series" that it publishes on a regular basis.

All indications concerning the chemical composition of the alloys are expressed as a percentage by weight based on the total weight of the alloy.

The temper definitions are indicated in European standard EN 515.

The static tensile mechanical properties, in other words the ultimate strength Rm, the conventional yield stress at 0.2% elongation Rp0.2, and the elongation to fracture A %, are determined by a tensile test according to standard NF EN ISO 6892-1.

Aluminum alloys are being used increasingly in the manufacture of motor vehicles because the use thereof makes it possible to reduce vehicle weight and thus decrease fuel consumption and the release of greenhouse gases.

Aluminum alloy sheets are used in particular for the manufacture of numerous "body-in-white" parts, among which a distinction can be made between: auto body skin parts (or external body panels) such as the front fenders, the roof or top, and the hood, trunk, or door parts; lining parts such as, for example, door, fender, hatch, and hood linings; and lastly, structural parts such as, for example, side-members, firewalls, load-bearing floors, and the front, middle, and rear pillars.

While numerous skin and lining parts are already made of aluminum alloy sheet, the transition from steel to aluminum for reinforcement or structural parts with improved properties is more delicate owing first to the fact that aluminum alloys exhibit poorer formability compared to steels, and second to the fact that the mechanical properties in general are not as good as those of the steels used for this type of part.

Indeed, for reinforcement or structural applications, a set of properties—which are sometimes contradictory—is required, such as:

high formability in the delivery temper, temper T4, in particular for stamping operations, a controlled elastic limit in the delivery temper of the sheet in order to control springback at the time of forming, high mechanical strength after cathodic painting and paint baking so as to achieve good mechanical strength in service while minimizing the weight of the part, a high capacity to absorb energy in the event of impact for applications involving body structure parts, good behavior in the various assembly processes used in auto body manufacturing, such as spot welding, laser welding, adhesive bonding, clinching, or riveting, good corrosion resistance, particularly against intergranular corrosion, stress corrosion, and filiform corrosion of the finished part, compatibility with requirements for the recycling of manufacturing waste or recycled vehicles, an acceptable cost for large-scale production.

However, there are already mass-produced motor vehicles having a body-in-white consisting mostly of aluminum alloys. For example, the 2014 Ford model F-150 is made of the structural alloy type AA6111. This alloy was developed by the "Alcan" group in the 1980s-1990s. There are two references that describe this development work: P. E. Fortin et al., "An optimized Al alloy for Auto body sheet application," EDMS technical conference, March 1984, describes the following composition:

| [Fortin] | Si | Fe | Cu | Mn | Mg | Cr | Zn | Ti |
|---|---|---|---|---|---|---|---|---|
| AA6111 | 0.85 | 0.20 | 0.75 | 0.20 | 0.72 | — | — | — |

M. J. Bull et al., "Al sheet alloys for structural and skin applications," 25th ISATA symposium, Paper 920669, June 1992:

The primary property remains a strong mechanical strength, even if it is firstly intended to withstand denting for skin type applications: "A yield-strength of 280 MPa is achieved after 2% pre-strain and 30 min at 177° C."

Furthermore, other alloys in the AA6xxx family with high mechanical properties have been developed for aeronautical or automotive applications.

For instance, the alloy AA6056, which was developed at "Pechiney" back in the 1980s, has been the focus of considerable work and numerous publications, either to optimize the mechanical properties or to improve the intergranular corrosion resistance. We will focus our attention on the automotive application of this type of alloy, for which a patent application was filed (WO2004113579A1).

The AA6013 alloys have also been the focus of considerable work.

For example, in patent application US2002039664 published in 2002 "Alcoa" combined good resistance to intergranular corrosion and an $Rp_{0.2}$ of 380 MPa in an alloy comprising 0.6-1.15% Si, 0.6-1% Cu, 0.8-1.2% Mg, 0.55-0.86% Zn, less than 0.1% Mn, 0.2-0.3% Cr, and about 0.2% Fe, used with a temper of T6.

At "Aleris," a patent application published in 2003, WO03006697, concerned an alloy in the AA6xxx series with 0.2 to 0.45% Cu. The purpose of the invention is to propose an alloy type AA6013 with a reduced level of Cu, targeting 355 MPa of Rm at a temper of T6, and good intergranular corrosion resistance. The claimed composition is as follows: 0.8-1.3% Si, 0.2-0.45% Cu, 0.5-1.1% Mn, and 0.45-1.0% Mg.

U.S. Pat. No. 5,888,320 describes a method for manufacturing a product made of aluminum, comprising: (A) the supply of an aluminum-based alloy consisting essentially of approximately 0.6 to 1.4 by weight. % of silicon, not more than about 0.5. % of iron, not more than about 0.6 by weight. % of copper, about 0.6 to 1.4 by weight. % of magnesium, about 0.4 to 1.4 by weight. % of zinc, at least one element chosen from the group consisting of about 0.2 to 0.8 by weight. % of manganese and of 0.05 to 0.3. % of chrome, the remainder essentially consisting of aluminum, secondary elements, and impurities; (B) homogenization, (C) hot working (D) solution heat treatment, and (E) quenching; in which the product has a loss of ductility of at least 5% less than a comparable treated alloy comprising approximately 0.88% by weight of Cu, 0.05% Zn, 0.75% by weight of Si, 0.17% by weight of Fe, 0.42% by weight of Mn, 0.95% by weight of Mg, 0.08% by weight of Ti and <0.01% by weight of Cr.

Patent application JPH05112840 describes an auto body sheet having a composition in % by weight of 0.4 to 1.5% Mg, 0.24 to 1.5% Si, 0.12 to 1.5% Cu, 0.1 to 1.0% Zn, 0.005 to 0.15% Ti, and at most 0.25% Fe, in which Si and Mg satisfy the relationship of Si at most 0.6 Mg (%), and containing at least one element from among 0.08 to 0.30% Mn, 0.05 to 0.20% Cr, 0.05 to 0.20% Zr, 0.04 to 0.10% V, and 0.0002 to 0.05% B, and the remainder Al with inevitable impurities.

Lastly, let us note that in all the aforementioned examples, the high mechanical properties ($Rp_{0.2}$, Rm) are obtained by resorting to alloys containing at least 0.5% copper.

Stated Problem

The purpose of the present invention is to provide sheets made of aluminum for auto body linings, reinforcements, or structures having a mechanical strength in service, after forming and paint baking, that is as high or even higher than the sheets of the prior art, while possessing good corrosion resistance, particularly against intergranular or filiform corrosion, satisfactory formability by ambient temperature stamping, and good behavior in various assembly processes such as spot welding, laser welding, adhesive bonding, clinching, or riveting.

SUMMARY

The subject matter of the invention is a sheet for a stamped lining, reinforcement, or structural auto body part still referred to as a body-in-white, made of an aluminum alloy from the AA6xxx series, having a low Cu content, with added hardening elements, particularly Zn, V, and Ti, typically having a thickness of between 1 and 5 mm, and a composition (% by weight) of:

Si: 0.85-1.20 and preferably: 0.90-1.10
Fe: <0.30 and preferably: 0.15-0.25
Cu: 0.10-0.30 and preferably: 0.10-0.20
Mg: 0.70-0.90 and preferably: 0.70-0.80
Mn: <0.30 and preferably: 0.10-0.20
Zn: 0.9-1.60, preferably 1.10-1.60, and furthermore preferably: 1.20-1.50
V: 0.02-0.30, preferably 0.05-0.30, and furthermore preferably: 0.10-0.20
Ti: 0.05-0.20 and preferably: 0.08-0.15
other elements <0.05 each and <0.15 total, balance aluminum, The subject matter of the invention is also a method for manufacturing the above sheets comprising the following steps:

casting, typically semi-continuous vertical casting of a plate and its possible scalping, homogenization at a temperature of 550 to 570° C. and holding for between 2 and 12 hours, preferably between 4 and 6 hours, followed by rapid cooling to ambient temperature, typically with blown air or water, reheating to a temperature of between 450 and 550° C. with holding for between 30 minutes and 3 hours, preferably substantially 2 hours, hot rolling of the plate into a strip having a thickness of between 3 and 10 mm, cold rolling to the final thickness, typically of between 1 and 5 mm, solution heat treatment of the rolled strip at a temperature greater than the solvus temperature of the alloy, while avoiding incipient melting, that is, between 550 and 570° C. for 5 seconds to 5 minutes, followed by quenching at a rate of more than 50° C./s and, better still, at least 100° C./s, pre-aging or reversion by coiling at a temperature of at least 60° C. followed by cooling of the resulting coil in the open air.

According to another variant, the above steps of homogenization and heating are replaced with a single step of heating to a temperature of between 550 and 570° C. and holding for between 2 and 12 hours, preferably between 4 and 6 hours, followed by the hot rolling as described above.

According to an advantageous embodiment, the sheet obtained by the above method has, after possible aging at an ambient temperature for between 72 hours and 6 months, a controlled tensile pre-deformation of 2% to simulate forming, and paint baking treatment typically for 20 minutes at 185° C., an elastic limit $Rp_{0.2}$ of at least 300 MPa.

Equally advantageously, the sheet obtained by the aforementioned method, with a temper of T6 according to European standard EN 515, i.e. typically after a complementary heat treatment at 205° C. for 2 hours or equivalent and an elastic limit $Rp_{0.2}$ of at least 350 MPa.

Equally advantageously, the sheet obtained by the aforementioned method has good corrosion resistance, particularly resistance to intergranular and filiform corrosion.

Lastly, such a sheet in a thickness of 2 mm, obtained by the aforementioned method, after possible aging at ambient temperature for between 72 hours and 6 months, a controlled tensile pre-deformation of 10%, and paint baking treatment, typically for 20 minutes at 185° C., has a "three-point bend angle" $\alpha_{10}$%, measured according to standard NF EN ISO 7438 and procedure VDA 238-100, of at least 60°.

DETAILED DESCRIPTION OF A PREFERRED EMBODIMENT

Figure 1:
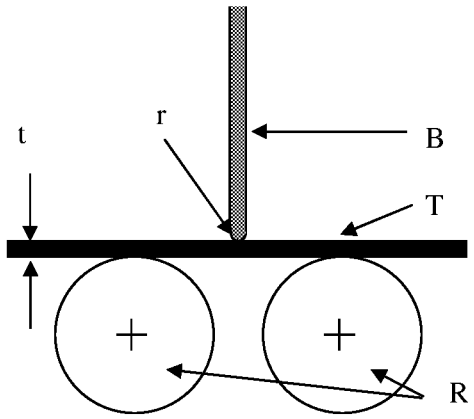
FIG. 1 shows the device for the "three-point bend test" consisting of two rollers R and a punch B of radius r for bending sheet T of thickness t.

The invention is based on the observation made by the applicant that a narrow composition range within the composition of an alloy belonging to the AA6xxx family registered with the "Aluminum Association," associated with a combined addition of Zn, V, and Ti, made it possible to obtain all of the desired properties, i.e. high in-service mechanical strength after forming and paint baking, in connection with the addition of zinc but combined in a surprising and unexpected way owing first to the simultaneous presence of V and Ti, with very satisfactory intergranular and filiform corrosion resistance, and satisfactory stamping formability at ambient temperature.

The concentration ranges imposed on the component elements of this type of alloy are consequently explained by the following reasons:

Si: The mechanical properties of aluminum alloys increase consistently with the silicon content. Silicon, together with magnesium, is the second alloying element of aluminum-magnesium-silicon systems (the AA6xxx family) for making intermetallic compounds $Mg_2Si$ or $Mg_5Si_6$, which contribute to the structural hardening of these alloys. The presence of silicon at a concentration of between 0.85% and 1.20%, combined with the presence of magnesium at a concentration of between 0.70% and 0.90%, makes it possible to obtain the required ratio of Si to Mg in order to achieve the desired mechanical properties, while ensuring good corrosion resistance and satisfactory forming by stamping at ambient temperature.

The most advantageous concentration range is 0.90 to 1.10%.

Mg: The level of the mechanical properties of alloys in the AA6xxx family is proportional to the magnesium content. When combined with silicon to form the intermetallic compounds $Mg_2Si$ or $Mg_5Si_6$, magnesium contributes to an augmenting of the mechanical properties. A minimum content of 0.70% is necessary to obtain the required level of mechanical properties and to form enough hardening precipitates. In addition, the solvus temperature, which corresponds to the solution heat treatment, of these alloys is highly dependent upon the magnesium content. Beyond 0.90%, the solvus temperature becomes too high thus posing problems of industrial solution heat treatment.

The most advantageous concentration range is 0.70 to 0.80%.

Fe: Iron is always present as an impurity in the "primary aluminum," since, like silicon, it comes from the ore, bauxite, from which alumina is extracted. A minimum content of 0.05%, and better still 0.15%, substantially decreases the solubility of manganese in solid solution, which makes it possible to obtain a sensitivity to the positive strain rate, delays break during deformation after necking, and therefore improves ductility and formability. Iron is also necessary for the formation of a high density of intermetallic particles ensuring good "hardenability" during the forming process. In these concentrations, iron also makes it possible to control the size of the grains. Beyond a concentration of 0.30%, too many intermetallic particles are created with a negative effect on ductility and corrosion resistance.

The most advantageous concentration range is 0.15 to 0.25%.

Mn: its concentration is limited to 0.30%. The addition of manganese beyond 0.05% can increase the mechanical properties by the solid solution effect, but beyond 0.3% it would cause the sensitivity to the strain rate and therefore the ductility to drop very precipitously.

An advantageous range is from 0.10 to 0.20%.

Cu: In the alloys of the AA6000 family, copper serves as an effective hardening element by participating in precipitation hardening. At a minimum concentration of 0.10%, its presence makes it possible to obtain better mechanical properties. Beyond 0.30%, copper has a negative influence on corrosion resistance.

The most advantageous concentration range is 0.10 to 0.20%.

Zn: the effect of adding Zn to AA6xxx alloys on mechanical properties and corrosion resistance is not entirely understood. A minimum concentration of 0.9% is necessary to obtain the required level of mechanical properties by solid solution hardening. Preferably, the minimum concentration of Zn is 1.10%. Furthermore, the addition of Zn to aluminum alloys belonging to the AA6xxx family modifies the solidus temperature. The more added Zn, the lower the solidus temperature, thus reducing the difference between the solvus temperature and the solidus temperature and making the industrial scaling of such an alloy difficult. Beyond 1.60%, this difference becomes too critical. The most advantageous concentration range is from 1.20 to 1.50%.

V and Ti: a minimum concentration of 0.02% vanadium and 0.05% titanium is necessary to achieve a solid solution hardening leading to the required level of mechanical properties and, in combination with the addition of Zn, each of these elements also has a favorable effect on the in-service ductility and corrosion resistance. Preferably, the minimum concentration of vanadium is 0.05%. However, a maximum concentration of 0.20% for Ti and 0.30% for V is required so as not to form primary phases in vertical casting, which have a negative impact on all of the claimed properties. The most advantageous concentration range is from 0.10 to 0.20% for V and from 0.08 to 0.15 for Ti.

The method for making the sheets of the invention typically comprises the casting of a plate and potentially scalping of the plate, following by:

either the homogenization thereof at a rate of at least 30° C./h up to a temperature of 550 to 570° C. with a hold for between 2 and 12 hours, preferably between 4 and 6 hours, followed by rapid blown-air or water cooling to ambient temperature, then reheating to a temperature of between 450 and 550° C. with a hold for between 30 minutes and 3 hours, preferably substantially 2 hours, or directly reheating to a temperature of 550 to 570° C. with a hold for between 2 and 12 hours, preferably between 4 and 6 hours.

Then comes hot rolling of the plate into a strip having a thickness of between 3 and 10 mm, cold rolling to the final thickness, typically between 1 and 5 mm, solution heat treatment of the rolled strip at a temperature beyond the solvus temperature of the alloy, while avoiding incipient melting, i.e. between 550 and 570° C. for 5 seconds to 5 minutes and preferably for 30 seconds to 5 minutes, quenching at a rate of more than 50° C./s and, better still, at least 100° C./s, and lastly pre-aging or reversion by coiling at a temperature of at least 60° C. followed by cooling of the resulting coil in the open air.

In this way, the sheets according to the invention have a satisfactory aptitude for stamping at ambient temperature. Equally advantageously, after forming, assembly, and paint baking, these sheets have high mechanical properties and good corrosion resistance, particularly against intergranular corrosion and filiform corrosion.

Examples

Introduction

Table 1 summarizes the nominal chemical compositions (% by weight) of the alloys used in the tests.

The casting plates of these various alloys were made by semi-continuous vertical casting.

After scalping, these various plates underwent a homogenization heat treatment and/or reheating, the temperatures of which are given in Table 2. The plates of cases 1, 6, 7, 8, and 10 underwent a homogenization treatment at 570° C. consisting of a temperature rise at a rate of 30° C./h up to 570° C., a holding time on the order of 5 hours at 570° C., then controlled blown-air cooling down to ambient temperature. This homogenization step is followed by a reheating step consisting of a temperature rise at a rate of 70° C./h up to 480° C. with a hold time on the order of 40 minutes, directly followed by hot rolling. The plates of case 2 underwent a homogenization treatment at 562° C. consisting of a temperature rise at a rate of 30° C./h up to 562° C., a holding time on the order of 5 hours at 562° C., then controlled cooling down to ambient temperature. The homogenization step is followed by a reheating step consisting of a temperature rise at a rate of 60° C./h up to 530° C. with the temperature being held for a maximum of 2 hours, followed by hot rolling. The plates of cases 3 and 5 underwent a reheating consisting of a rise to 565° C. and 550° C., respectively, with a minimum hold of 2 hours at these temperatures, directly followed by hot rolling. The plates of cases 4 and 9, consisting of alloy types AA6016 and AA5182, underwent conventional homogenizations for these types of alloys.

The subsequent hot rolling step takes place on a reversing rolling mill followed, depending on the case, by a tandem hot rolling mill with 4 stands to a thickness of between 3 and 10 mm. The thicknesses of the tested cases at the hot rolling mill output are given in Table 2.

This hot rolling step is followed by a cold rolling step making it possible to produce sheets in thicknesses of between 1.7 and 2.5 mm. The thicknesses of the tested cases at the cold rolling mill output are given in Table 2.

The rolling steps are followed by a solution heat treatment step and quenching. The solution heat treatment is done at a temperature beyond the solvus temperature of the alloy, while avoiding incipient melting. The sheet undergoing solution heat treatment is then hardened at a minimum rate of 50° C./s. In all the cases, except cases 4 and 9, this step is done in a continuous furnace by raising the temperature of the metal to 570° C. in less than approximately one minute, directly followed by quenching. For case 4, with an alloy type AA6016, the cold rolling was also followed by a heat treatment at the end of the process consisting of a solution heat treatment and quenching performed in a continuous furnace by raising the temperature of the metal to 540° C. in approximately 30 seconds and quenching at a minimum rate of 50° C./s. For case 9, with an alloy type AA5182, the recrystallization annealing took place in a continuous furnace and consisted in bringing the metal to a temperature of 365° C. in approximately 30 seconds, and then cooling the metal.

The quenching is followed by a pre-aging heat treatment intended to improve the performance of the hardening when the paints are being baked. For all the tested cases, except case 9, this step is conducted by coiling at a temperature of at least 60° C. followed by cooling in the open air. The coiling temperatures are described in Table 2.

TABLE 1

| Composition | Si | Fe | Cu | Mn | Mg | Zn | Ti | V |
|---|---|---|---|---|---|---|---|---|
| Invention 1 | 0.92 | 0.19 | 0.16 | 0.18 | 0.72 | 1.47 | 0.08 | 0.15 |
| Invention 2 | 0.94 | 0.20 | 0.17 | 0.17 | 0.72 | 1.52 | 0.11 | 0.15 |
| Invention 3 | 0.95 | 0.20 | 0.16 | 0.18 | 0.74 | 1.20 | 0.10 | 0.14 |
| Alloy 4 | 1.05 | 0.25 | 0.09 | 0.17 | 0.37 | 0.02 | 0.02 | 0.00 |
| Alloy 5 | 1.08 | 0.25 | 0.18 | 0.18 | 0.57 | 0.01 | 0.02 | 0.00 |
| Alloy 6 | 0.81 | 0.15 | 0.16 | 0.17 | 0.79 | 0.01 | 0.02 | 0.00 |
| Alloy 7 | 0.63 | 0.19 | 0.16 | 0.17 | 0.97 | 1.46 | 0.09 | 0.15 |
| Alloy 8 | 0.93 | 0.20 | 0.16 | 0.18 | 0.78 | 0.05 | 0.03 | 0.01 |
| Alloy 9 | <0.20 | <0.35 | 0.07 | 0.33 | 4.65 | 0.01 | 0.02 | 0.00 |
| Alloy 10 | 0.79 | 0.29 | 0.80 | 0.003 | 0.71 | 0.49 | 0.05 | 0.01 |

TABLE 2

| | Homogenization | Reheating | Thickness at hot rolling mill output | Thickness at cold rolling mill output | Pre-aging |
|---|---|---|---|---|---|
| Invention 1 | 570° C. | 480° C. | 10 mm | 2.0 mm | 85° C. |
| Invention 2 | 562° C. | 530° C. | 10 mm | 2.5 mm | 65° C. |
| Invention 3 | X | 565° C. | 10 mm | 2.0 mm | 80° C. |
| Alloy 4 | — | — | 6.0 mm | 2.0 mm | 70° C. |
| Alloy 5 | X | 550° C. | 3.0 mm | 1.7 mm | 60° C. |
| Alloy 6 | 570° C. | 480° C. | 10 mm | 2.0 mm | 85° C. |
| Alloy 7 | 570° C. | 480° C. | 10 mm | 2.0 mm | 85° C. |
| Alloy 8 | 570° C. | 480° C. | 10 mm | 2.0 mm | 85° C. |
| Alloy 9 | — | — | 4.3 mm | 2.5 mm | — |
| Alloy 10 | 570° C. | 480° C. | 8 mm | 2.0 mm | 85° C. |

Tensile Tests

The tensile tests at ambient temperature were conducted according to standard NF EN ISO 6892-1 with non-proportional test specimens having a geometry widely used for sheets and corresponding to test specimen type 2 in Table B.1, Appendix B, of said standard. In particular, these test specimens are 20 mm wide and have a calibrated length of 120 mm.

The results of these tensile tests in terms of the 0.2% proof stress, $Rp_{0.2}$, and measured on the sheets as manufactured under the conditions described in the foregoing section, that is, after quenching, pre-aging, aging at ambient temperature for a minimum period of 72 hours, then 2% work hardening under controlled traction to simulate forming and holding for 20 minutes at 185° C. to simulate paint baking, are given in Table 3 below.

TABLE 3

| | $Rp_{0.2}$ [MPa] |
|---|---|
| Alloy 4 | 217 |
| Alloy 5 | 264 |
| Alloy 6 | 282 |
| Alloy 7 | 288 |
| Alloy 8 | 291 |
| Invention 1 | 309 |
| Invention 2 | 316 |
| Invention 3 | 307 |

One can clearly see that the elastic limits of the sheets made of alloys 1, 2, and 3 according to the invention are greater than 300 MPa, as claimed, which is not the case for the other alloys.

The results of these tensile tests, once again in terms of the 0.2% proof stress, $Rp_{0.2}$, but measured on the sheets as manufactured under the conditions described in the foregoing section, with temper T6, that is, after quenching, pre-aging, aging at ambient temperature for a minimum period of 72 hours, and then annealed to achieve temper T6 at the peak of hardening, i.e. 2 hours at 205° C., are given in Table 4 below.

TABLE 4

| | $Rp_{0.2}$ [MPa] |
|---|---|
| Alloy 3 | 249 |
| Alloy 4 | 310 |
| Alloy 5 | 336 |
| Alloy 6 | 347 |
| Alloy 7 | 343 |
| Alloy 9 | 344 |
| Invention 1 | 355 |
| Invention 2 | 357 |
| Invention 3 | 354 |

One can clearly see that the elastic limits of the sheets made of alloys 1, 2, and 3 according to the invention are greater than 350 MPa, as claimed, which is not the case for the other alloys.

Evaluation of in-Service Ductility

The in-service ductility can be estimated by a "three-point bend test" according to standard NF EN ISO 7438 and procedure VDA 238-100.

The bending device is as shown in FIG. 1.

First, a controlled tensile pre-deformation of 10% in the direction perpendicular to the rolling direction is performed on a sheet with temper T4, i.e. after quenching, pre-aging, and aging at ambient temperature for 72 hours, then a hold for 20 minutes at 185° C. to simulate paint baking, and then the actual "three-point bending" is done using a punch B with radius r=0.4 mm, with the sheet being supported by two rollers R and the bending axis being perpendicular to the pre-traction direction. The rollers are 30 mm in diameter and the distance between the axes of the rollers is 30+2t mm, with t being the initial thickness of tested sheet T.

At the beginning of the test, the punch is brought into contact with the sheet with a pre-force of 30 Newtons. Once contact is established, the movement of the punch is indexed to zero. The test then consists in moving the punch so as to perform the "three-point bending" of the sheet.

The test is stopped when a microcracking of the sheet leads to a drop in force on the punch of at least 30 Newtons or when the punch has moved by 14.2 mm, which is the maximum authorized travel.

Figure 2:
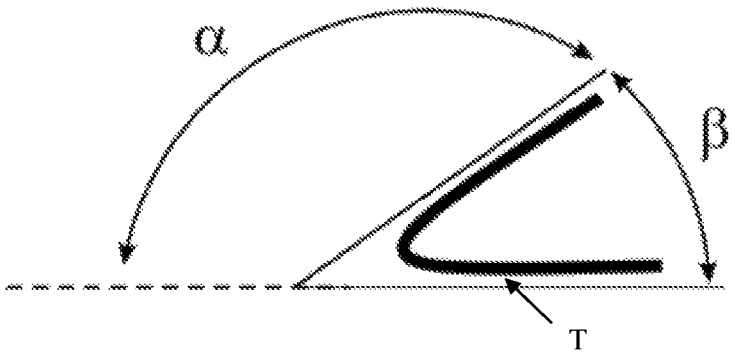
FIG. 2 shows sheet T after the "three-point bend" test with inside angle β and the outside angle, the measured result of the test: α still referred to as $\alpha_{10\%}$.

At the end of the test, the sheet sample is bent as shown in FIG. 2. The in-service ductility is then assessed by measuring the bending angle $\alpha$, referred to here as $\alpha_{10\%}$, in degrees. The greater angle $\alpha_{10\%}$, the better the aptitude of the sheet for hemming or bending.

The results of these bending tests on the sheets as made under the conditions described in the "Introduction" section are given in Table 5 below.

TABLE 5

| | $\alpha_{10\%}$ (°) |
|---|---|
| Alloy 4 | 63 |
| Alloy 7 | 52 |
| Invention 1 | 61 |

Once can clearly see that the angle $\alpha_{10\%}$of the sheet according to the invention is greater than 60°.

Measurement of the LDH (Limit Dome Height)

These LDH (Limit Dome Height) measurements were taken in order to characterize the stamping performance in temper T4 of the various sheets of this example.

The LDH parameter is widely used to evaluate the stamping aptitude of sheets in thickness of 0.5 to 3.0 mm. It has been the topic of numerous publications, particularly that of R. Thompson, "The LDH test to evaluate sheet formability—Final Report of the LDH Committee of the North American Deep Drawing Research Group," SAE conference, Detroit, 1993, SAE Paper n° 930815.

This is a stamping test of a blank held peripherally by a ring. The blank-clamping pressure is controlled to avoid any sliding in the ring. The blank, which measures 120×160 mm, is stressed in a manner close to plane strain. The punch used is hemispherical.

Figure 3:
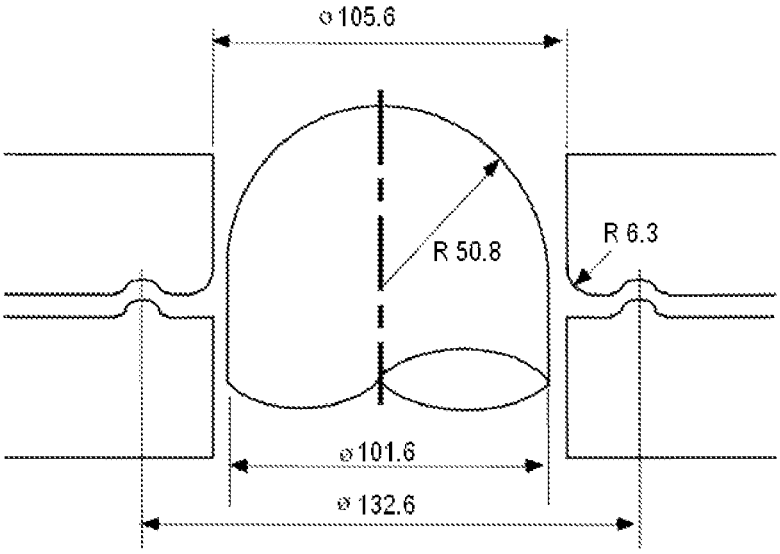
FIG. 3 specifies the dimensions in mm of the tools used to determine the value of the parameter known to a person skilled in the art by the name of LDH (Limit Dome Height), which is characteristic of the material's aptitude for stamping.

FIG. 3 specifies the dimensions of the tools used to perform this test.

Lubrication between the punch and the sheet is provided by graphite grease (Shell HDM2 grease). The punch descent speed is 50 mm/min. The so-called LDH value is the value of the punch travel at breakage, that is, the stamping depth limit. In actuality, it is an average of three tests yielding a 95% confidence interval of 0.2 mm in the measurement.

Table 6 below indicates the values of the LDH parameter obtained on 120×160 mm test specimens cut from the aforementioned 2.5 mm thick sheets, in which the 160 mm dimension was placed parallel to the rolling direction.

TABLE 6

| | LDH (mm) |
|---|---|
| Alloy 8 | 37.1 |
| Invention 2 | 36.5 |

These results highlight the fact that the sheet of the invention has an LDH value comparable to the LDH value obtained for a sheet made of type AA5182 alloy (alloy 8), the reference alloy in the case of body panels for severe stamping.

Evaluation of Corrosion Resistance

The intergranular corrosion test according to ISO Standard 11846 consists in immersing the test specimens in a sodium chloride (30 g/l) and hydrochloric acid (10 ml/l) solution for 24 hours at a temperature of 30° C. (obtained by keeping in a dry furnace) after hot pickling with sodium hydroxide (5% by weight) and nitric acid (70% by weight) at ambient temperature.

The dimensions of the samples are 40 mm (in the rolling direction)×30 mm×thickness. The type and depth of the resulting corrosion are determined by a metallographic section examination of the metal. The maximum corrosion depth is measured.

The results are summarized in Table 7 below.

TABLE 7

| | Maximum etching depth in μm |
|---|---|
| Alloy 9 | 250 |
| Invention 1 | 140 |

The maximum etching depth is shown to be markedly less for the alloy of the invention, reflecting better resistance to intergranular corrosion.

The invention claimed is:

1. A sheet for stamped lining, reinforcement, or structural parts for an auto body, made of aluminum alloy from the AA6xxx series, (% by weight):

Si: 0.85-1.20
Fe: <0.30
Cu: 0.10-0.30
Mg: 0.70-0.90
Mn: <0.30
Zn: 0.9-1.60
V: 0.02-0.30
Ti: 0.05-0.20 other elements <0.05 each and <0.15 total, balance aluminum;

wherein the sheet is manufactured by a process comprising:

(a) casting, optionally semi-continuous vertical casting, of a plate and optionally scalping the plate, (b) homogenizing the plate from (a) at a temperature from 550 to 570° C. with a hold for from 2 to 12 hours, followed by rapid cooling, and reheating to a temperature of from 450 to 550° C. with holding for from 30 minutes to 3 hours, or (b') directly reheating the plate from (a) to a temperature of 550 to 570° C. with holding for from 2 to 12 hours, (c) hot rolling the plate from (b) or (b') into a strip having a thickness of from 3 to 10 mm, (d) cold rolling to a final thickness of from 1 to 5 mm, (e) solution heat treating the cold-rolled strip at a temperature greater than the solvus temperature of the alloy, while avoiding incipient melting, that is, from 550 to 570° C. for 5 seconds to 5 minutes, followed by quenching at a rate of more than 50° C./s, (f) pre-aging or reversion by coiling at a temperature of at least 60° C. followed by cooling of the resulting coil in open air, and (g) aging at ambient temperature for from 72 hours to 6 months, wherein the sheet exhibits at least one of the following characteristics:

(1) an elastic limit $Rp_{0.2}$ of at least 300 MPa after further undergoing:

(h) a controlled tensile pre-deformation of 2%, and (i) paint baking treatment, (2) in temper T6 according to European standard EN 515, the sheet has an elastic limit $Rp_{0.2}$ of at least 350 MPa after further undergoing (h') annealing, or (3) the sheet, having a thickness of 2 mm, has a "three-point bend angle" $\alpha_{10\%}$, measured according to standard NF EN ISO 7438 and procedure VDA 238-100, of at least 60° after further undergoing:

(h") a controlled tensile pre-deformation of 10%, and (i) paint baking treatment.

2. The sheet according to claim 1, wherein the Si concentration is from 0.90 to 1.10%.

3. The sheet according to claim 1, wherein the Cu concentration is from 0.10 to 0.20%.

4. The sheet according to claim 1, wherein the Mg concentration is from 0.70 to 0.80%.

5. The sheet according to claim 1, wherein the Zn concentration is from 1.10 to 1.60%.

6. The sheet according to claim 1, wherein the V concentration is from 0.05 to 0.30%.

7. The sheet according to claim 1, wherein the Ti concentration is from 0.08 to 0.15%.

8. The sheet according to claim 1, wherein the Mn concentration is from 0.10 to 0.20%.

9. The sheet according to claim 1, wherein the Fe concentration is from 0.15 to 0.25%.

10. The sheet according to claim 1, wherein the sheet has an elastic limit $Rp_{0.2}$ of at least 300 MPa.

11. The sheet according to claim 1, wherein, in temper T6 according to European standard EN 515, the sheet has an elastic limit $Rp_{0.2}$ of at least 350 MPa.

12. The sheet according to claim 1, wherein when the sheet is 2 mm thick, the controlled tensile pre-deformation is 10%, and wherein the sheet has a "three-point bend angle" $\alpha_{10\%}$ measured according to standard NF EN ISO 7438 and procedure VDA 238-100, of at least 60°.

13. The sheet according to claim 1, wherein the Zn concentration is from 1.20 to 1.50%.

14. The sheet according to claim 1, wherein the V concentration is from 0.10 to 0.20%.

15. The sheet according to claim 1, wherein (b') occurs, and wherein in (b'), said holding is for 2 hours.

16. The sheet according to claim 1, where (b') occurs, and wherein in (b'), said holding is for between 4 and 6 hours, and wherein the quenching in (e) is at a rate of more than 100° C./s.

17. A method for making the sheet according to claim 1 comprising:

casting, optionally semi-continuous vertical casting, of a plate and optionally scalping the plate, homogenizing said plate at a temperature from 550 to 570° C. with a hold for from 2 to 12 hours, followed by rapid cooling, reheating to a temperature of from 450 to 550° C. with holding for from 30 minutes to 3 hours, hot rolling the plate into a strip having a thickness of from 3 to 10 mm, cold rolling to a final thickness, solution heat treating the cold-rolled strip at a temperature greater than the solvus temperature of the alloy, while avoiding incipient melting, that is, from 550 to 570° C. for 5 seconds to 5 minutes, followed by quenching at a rate of more than 50° C./s, pre-aging or reversion by coiling at a temperature of at least 60° C. followed by cooling of the resulting coil in open air.

18. A method for making the sheet according to claim 1 comprising:

casting, optionally semi-continuous vertical casting, of a plate and optionally scalping the plate, reheating the plate to a temperature of from 550 to 570° C. and holding for 2 to 12 hours, optionally between 4 and 6 hours, hot rolling the plate into a strip having a thickness of from 3 to 10 mm, cold rolling to the final thickness, solution heat treating the rolled strip at a temperature greater than the solvus temperature of the alloy, while avoiding incipient melting, that is, from 550 to 570° C. for 5 seconds to 5 minutes, followed by quenching at a rate of more than 50° C./s, pre-aging or reversion by coiling at a temperature of at least 60° C. followed by cooling of the resulting coil in open air.

19. The method according to claim 17, further comprising:

optionally aging the sheet at ambient temperature for from 72 hours to 6 months, 2% controlled tensile pre-deformation, and paint baking treatment, optionally for 20 minutes at 185° C.

* * * * *